US006024846A

United States Patent [19]

Legoupil

[11] Patent Number: 6,024,846

[45] Date of Patent: Feb. 15, 2000

[54] INSTALLATION FOR ELECTROLYTIC COATING OF METALLIC BANDS AND ANODE FOR SUCH AN INSTALLATION

[75] Inventor: Jean-Luc Legoupil, Paris, France

[73] Assignee: Kvaerner Metals Clecim, Paris, France

[21] Appl. No.: 09/108,319

[22] Filed: Jul. 1, 1998

[30] Foreign Application Priority Data

Jul. 2, 1997 [FR] France ..... 97 08351

[51] Int. Cl.[7] ..... C25D 17/00

[52] U.S. Cl. ..... 204/206

[58] Field of Search ..... 204/206, 196.09, 204/229.4

[56] References Cited

U.S. PATENT DOCUMENTS

| | | | |
|---|---|---|---|
| 4,310,403 | 1/1982 | Nitto et al. | 204/206 |
| 4,762,602 | 8/1988 | Bechem et al. | 204/206 |
| 5,236,566 | 8/1993 | Tsuchiya et al. | 204/206 |

FOREIGN PATENT DOCUMENTS

| | | |
|---|---|---|
| 0 254 703 | 1/1988 | European Pat. Off. . |
| 2 323 788 | 11/1974 | Germany . |
| 90/08209 | 7/1990 | WIPO . |

OTHER PUBLICATIONS

Toyoda Toshio: "Control of the Thickness During Electroplating of Metal Strip", Chemical Abstracts, vol. 87, No. 26, Dec. 26, 1977, Columbus, Ohio, p. 448.

*Primary Examiner*—Donald R. Valentine
*Assistant Examiner*—Erica Smith-Hicks
*Attorney, Agent, or Firm*—Nikaido, Marmelstein, Murray & Oram LLP

[57] ABSTRACT

The invention relates to an installation for coating a metallic band by guiding the latter through an electrolytic bath (12), while passing in front of at least one anode plate (13) constituted of a set of bars arranged beside one another along a direction transversal to the forward direction (A) of the band (23) and carried by an anode bridge (14), whereas each bar forms an anode section (18). According to the invention, each anode bridge (14) comprises a carrier beam (31) along which have been arragned, one after the other, a number of live pins (32) isolated electrically from one another and linked separately to the source of current by an individual switching device (35), in order to enable fractional electric power supply of each of the anode sections (18).

9 Claims, 4 Drawing Sheets

FIG.6
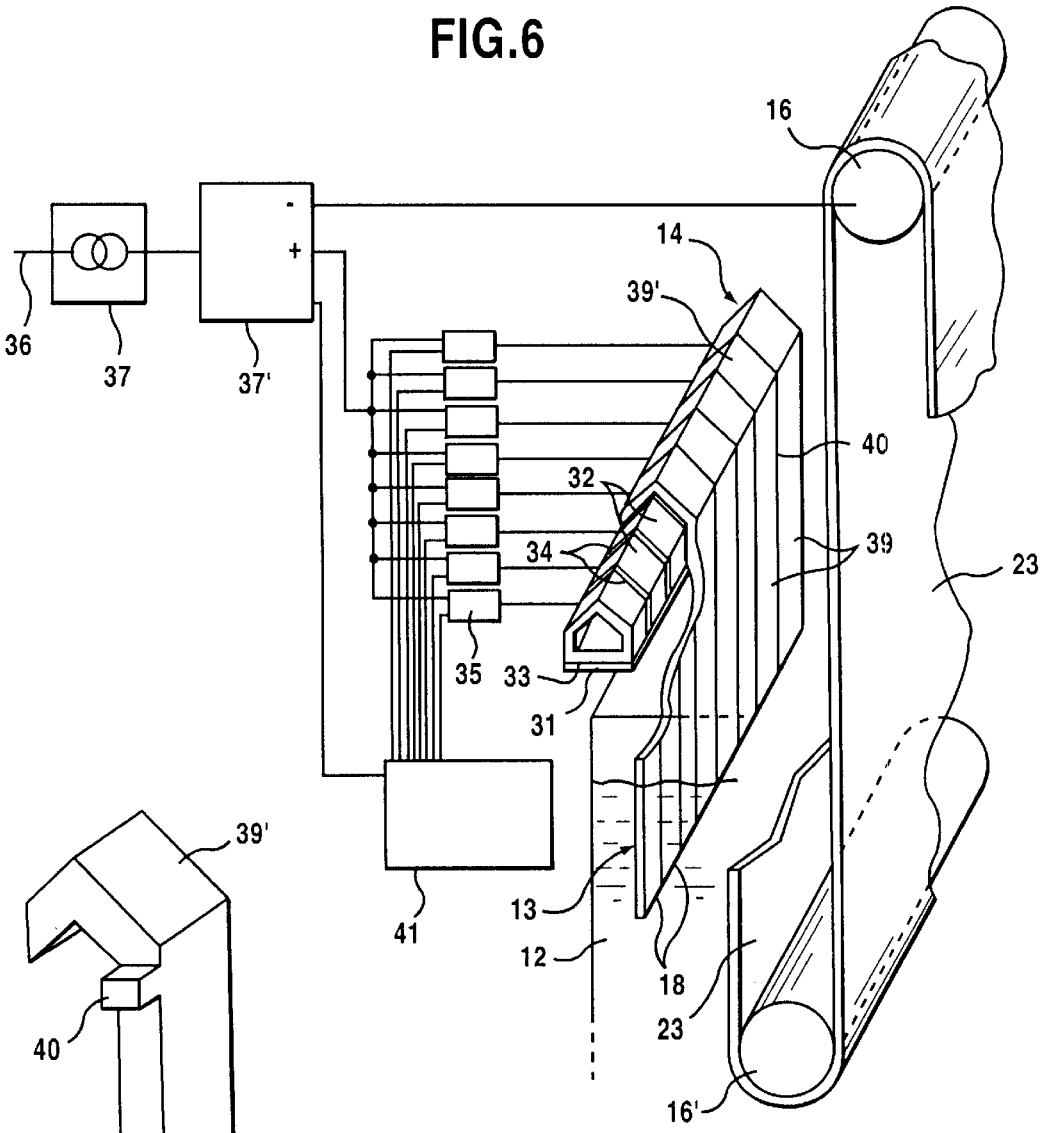
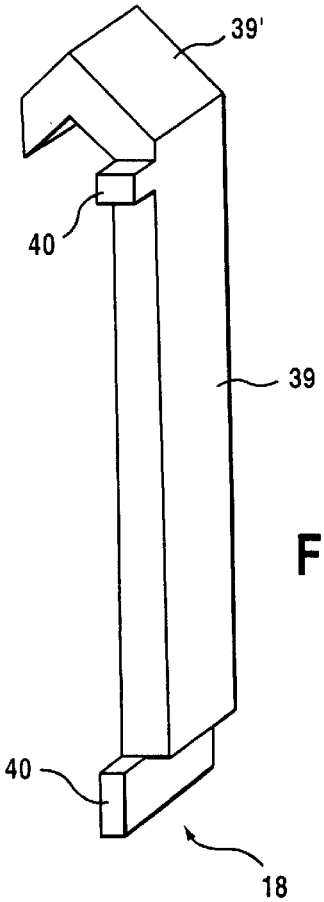
FIG.4

INSTALLATION FOR ELECTROLYTIC COATING OF METALLIC BANDS AND ANODE FOR SUCH AN INSTALLATION

The invention relates to an installation for electrolytic coating of metallic bands and more particularly to a tinning, galvanising or chroming line.

In such an installation, a metallic band passes through an electrolytic bath containing the metal to be deposited. A treatment section is divided into horizontal or vertical cells swept successively by the band, which passes over a series of rollers delineating a zigzag trajectory. The band is linked to a pole of a continuous current source via certain live rollers and passes in front of metallic plates placed between the rollers and linked to the other pole. Normally, the live rollers link the band to the negative pole and the metallic plates are linked to the positive pole. Thus, each metallic plate forms an anode in front of which runs an edge of the band, which forms the cathode of the electrolytic device.

These metallic plates can be constituted of the metal to be deposited in the soluble electrode process or of a metal that cannot be attacked by the electrolytic bath in the insoluble electrode process.

In the case of soluble electrodes, the bath is supplied with metallic ions by the gradual dissolution of each metallic plate constituted of the coating metal and that should be renewed; in the case of insoluble electrodes, the electrolytic bath is supplied with ions of the metal to be applied by an auxiliary preparation and welding device which constitutes another chemical reactor.

Generally, the relative space dispositions of the band, the live rollers and anodes are designed to obtain a deposit on both faces of the band.

Installations of this type have been known for a long time, especially for tinning a band.

Generally speaking, in the tinning line, the band is unwound from a reel, passes through a tensioning device, then into a band accumulator and, after cleaning and etching, arrives at a tinning section constituted of several electrolysis cells filled with a treatment bath containing, for instance, tin salts in an acid environment.

At the output of the tinning cell, the band is subject to various treatments and passes successively through an accumulator and a tensioning device, before being wound into a reel.

The installations of this type are, generally satisfactory, but exhibit, however, various shortcomings.

First of all, the electrolytic effect is usually distributed uniformly over the width of the metallic band, but there may be irregularities in the thickness of the metal applied, especially on the rims.

Moreover, it is necessary to adapt the width covered by the anodeplates to the width of the band.

In the case of so-called insoluble electrode installations, the band runs vertically between anode plates made of a material non-sensitive to the electrolytic process used, such as for instance titanium, which contains iridium.

In order to control the thickness of the coating for regularity when applied over the whole width of the band, it has been suggested, in the document JP-A-52-1 8649, to divide each anode plate into a number of vertical bars, electrically isolated from one another and supplied separately under adjustable intensities, in order to modify, if needed, the distribution of the electric current.

Such a process is, however, hardly applicable to so-called soluble electrode installations.

Indeed, in the case of soluble electrodes, it is necessary to replace periodically the anode plates, which dissolve gradually. To this end, each anode plate is usually composed of attached bars, which are replaced as they are worn.

In an installation of this type, described for example in the document DE-2323788, each electrolysis cell comprises two anode plates between which runs the band and which are each constituted of vertical attached bars hanging from horizontal live bars, called anode bridges, linked to the positive pole. The anode bridge assembly carrying a plate constituted of adjacent vertical bars is called an anode bench.

Besides, the attached bars forming an anode plate can slide over the anode bridges which support them and are driven back by a pushing device, in order to make room, on one side of the band, for a new bar, whereas the last worn bar is evacuated from the other side. The thickness of the bars thus decreases gradually between the supply side and the evacuation side, as they are dissolved.

In another horizontal cell process, the tinning section comprises a bath filled with electrolytic fluid in which the band circulates while passing over deflecting rollers which define a zigzag trajectory comprising several horizontal running sections in alternate directions, respectively from left to right and from right to left. We thus obtain vertical superimposition of several horizontal treatment cells in which the band runs successively after having been turned over by 180° by the deflecting rollers, which enables to coat both faces of the band.

As in the vertical cell installation, each anode plate is constituted of a series of attached tin bars. The latter rest on supporting beams made of live metal, constituting the anode bridges, extending from one side of the band to the other, crosswise to the running direction.

In this case as well, the set of bars is slid over the anode bridge in order to make space available for a new bar, whereas the bar worn the most is removed at the other end.

With such arrangements, the width covered by the anode plate depends on the number of bars sliding over the anode bench. In case of changing the band width, it is necessary to add or to remove a number of bars in order to suit the width covered to that of the band. This causes a waste of time and calls for human intervention in an acid environment, which is particularly aggressive and toxic.

To suit the action of electric current to the width of the band to be treated, mobile masks can also be inserted between the electrodes and the band. However, to adapt the relative position of the masks to the width of the band, it is necessary to use mechanic displacement devices installed in a corrosive environment calling for costly materials and farreaching maintenance.

The invention remedies these shortcomings thanks to a particular arrangement enabling, without any complications of the installation and without modifying the effective width covered by the anode plate to the width of the metallic band to be treated. Besides, the invention enables, if needed, to change the current density transversally to the forward direction of the metallic band.

Other advantages of the invention will appear in the following description.

The invention therefore relates to an electrolytic coating installation for metallic bands, comprising:

- at least one electrolytic bath,
- means to control the running of a metallic band inside the electrolytic bath, along a running direction;
- at least one anode bridge comprising a carrier bar in the form of a beam extending along a horizontal direction, transversally to the running direction of the band,
- at least one anode plate constituted of a set of bars arranged beside one another and each forming an anode section comprising a portion made of the metal to be deposited on the band and soluble by electrolysis, whereas the said bars are carried by the anode bridge with the possibility of sliding along the latter, along a horizontal direction more or less perpendicular to the running direction of the band, means to control the sliding motion of the said bars along the anode bridge, between a supply side and a exhaust side of the former, for the replacement of a worn bar with a new bar, an electric supply circuit from a continuous electric current source with a negative pole connected by electric contacting means to the metallic band which forms a cathode, and a positive pole, separate electric supply means, fractional from each of the anode sections comprising a number of live pins arranged in succession along the carrier bar of the anode bridge, whereas the said live pins are electrically isolated from one another and from the carrier bar, whereas the said anode sections rest on the anode bridge via the said pins with the option of sliding along the aligned pins, whereas each live pin is electrically connected, on the one hand, to the positive pin of the current source by an individual controlled switching means and, on the other hand, to at least one anode section resting on the said live pin.

The invention thus provides with a current supply fractional in the direction of the band width so that the effective width of the anode plate corresponding to the current-supplied anode sections only covers the width of the band. This way, it is not necessary to remove or to add anode sections in case of modification of the band width.

To this end, each live pin is supplied selectively via a controlled semi-conductor power switching device.

Preferably, the electric power supply means are designed to enable adjustment of the intensity of the current passing through the associated anode section. It is thus possible to modulate at will the current in each section via remote controllable electronic components.

Particularly advantageously, the electric power supply means are associated with a programmable computing unit for selective trigger control of the power switching means in relation to the dimensions of the band and of the anode sections, whereas the computing means is programmed in order to control the electric supply solely for the live pins corresponding to a set of sections covering a width not exceeding that of the band.

According to another preferred characteristic, each live pin exhibits an upper part with a reverted V-shaped transversal portion and each anode section exhibits in its upper part a bent extremity forming a hook of matching shape, liable to be hooked onto the live pin while establishing the electric current.

Generally, such an installation comprises a series of anodes arranged in succession and each comprising an anode plate carried by an anode bridge.

In such a case, particularly advantageously, the sealing planes between the anode sections of two successive anode plates will be offset transversally to the running direction of the band so that the insulating zones between the sections of two successive anode plates are not aligned according to the direction of the running axis of the band.

BRIEF DESCRIPTION OF THE DRAWINGS

The invention also covers other advantageous provisions, which will appear in the detailed description of certain embodiments of the invention with reference to the appended drawings.

FIG. 4 shows schematically, in perspective, an anode section according to the invention.

FIG. 6 is a diagram of an electric power supply circuit of an anode bench according to the invention.

The invention will be described in detail with reference to an installation of the type described, for example in the document DE-A2323788, comprising a series of vertical attached cells in which the band runs alternately in the ascending direction and in the descending direction.

Figure 2:
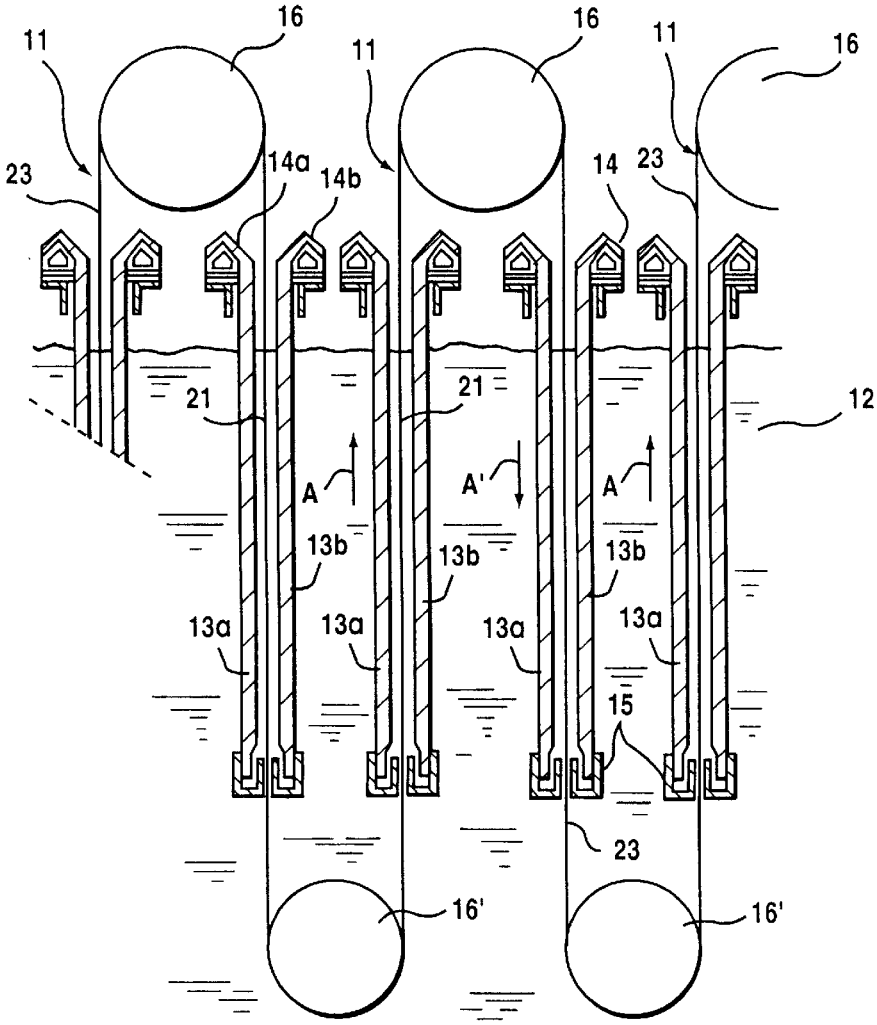
FIG. 2 is a detailed view, at enlarged scale, showing several treatment cells, as a transversal section along line II—II of FIG. 1.

FIG. 2 shows schematically a portion of such an installation constituted of a series of vertical electrolysis cells 11 in which the band 23 runs vertically along alternate directions, respectively descending and ascending directions, while passing over two series of deflecting rollers 16, 16', offset vertically and delineating a zigzag trajectory. The lower rollers 16' are immersed whereas the upper rollers 16 are placed above the surface of the treatment bath 12. Moreover, these upper rollers 16 are electrically live and connected to the negative pole of a continuous supply source.

Each cell 11 is thus centered around an upper live conductor 16 and associated with two lower immersed rollers 16' and with two pairs of anode benches working together respectively with an ascending edge 21' or a descending edge 21 passing between both anode benches which each comprise an anode plate 13 supported by an anode bridge 14.

Each edge, respectively descending 21 or ascending 21', thus runs between two anode plates 13*a*, 13*b*, separated by a small distance and supported, respectively, at their upper extremity, by two anode bridges 14 extending above the bath 12, transversally to the running direction A of the band, whereas the greatest part of the plate is immersed. At its lower extremity, each band edge is maintained by guiding means 15. The band is stretched and driven into motion by the take-up rollers 16 themselves brought into rotation by means which have not been represented here.

Figure 1:
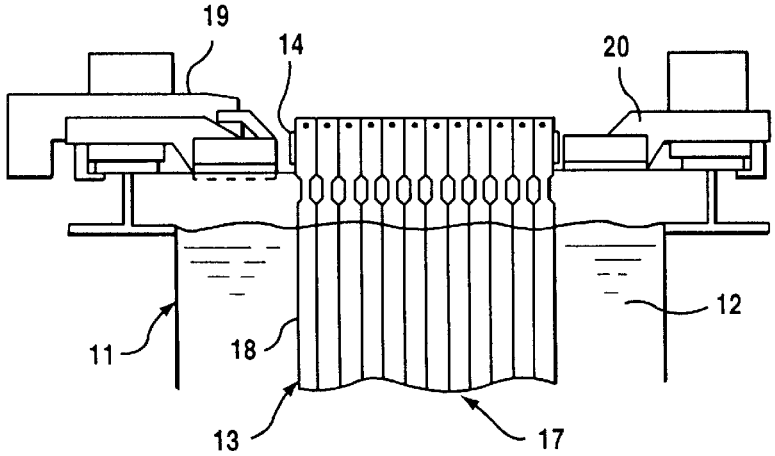
FIG. 1 shows schematically, as a front view, the assembly of an anode plate according to the invention.

As shown on FIG. 1, each anode plate is constituted, as well-known in itself, of a set of vertical attached bars 18 which have been hooked in order to be able to slide over the anode bridge 14 forming a transversal supporting beam extending above the bath 12. The set of bars 13 is fixed and pushed into translation by a pushing device 19 and a fixing device 20.

Both anode plate 13*a*, 13*b* each constituted of a set of hanging bars and located, respectively, on either side of the same edge 21 of the band, are pushed in reverse direction.

Figure 5:
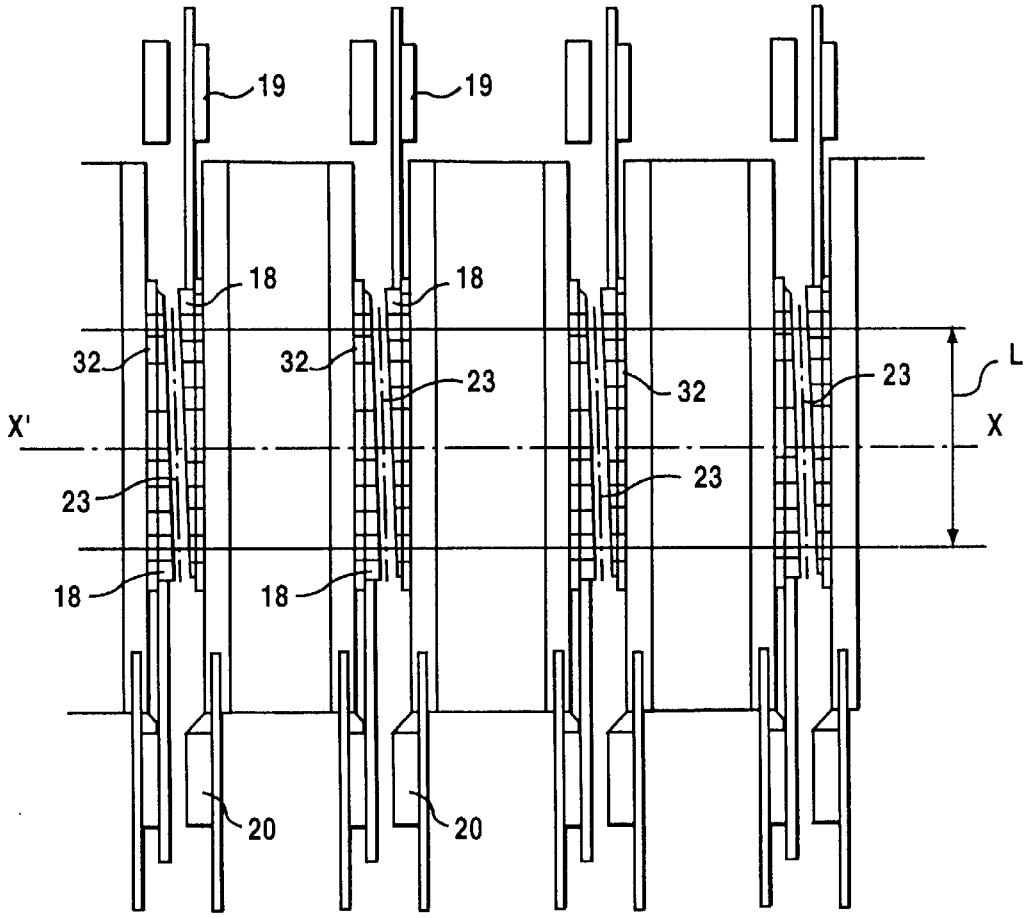
FIG. 5 shows, from beneath, the global arrangement of several anode benches, in an electrolysis section.

Moreover, as shown on FIG. 5, in order to compensate for the reduction in thickness of the bars along their paths, the anode bridges 14 and the pushing 19 and fixing 20 devices are oriented in order to form an angle of a few degrees with the vertical running plane of the band edge 21 so that the said band is more or less parallel to the faces oriented toward both anode plates 13, 13', taking into account the progressive wear of the bars 18 constituting each plate. The distance between the surface of the bars 18 and the band 23 is thus maintained constant over the whole width of the band in order to have more or less the same current densities and, thus, a uniform deposit thickness.

Figure 3:
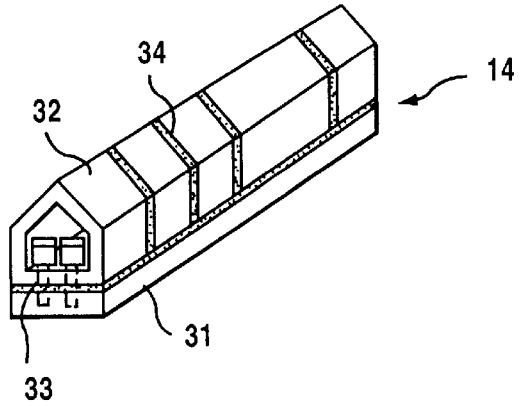
FIG. 3 is a schematic view, in perspective, of a fractional anode bridge.

In order to supply, according to the invention, each bar 18 individually, constituting a section of an anode plate 13, each corresponding anode bridge 14 (FIG. 3) is made of a carrier beam 31 with sufficient resistance to support the set of bars 18 and on which live pins 32 are fixed mechanically, pins which are, on the one hand, electrically isolated from the beam 31 by a plate 33 and, on the other hand, isolated from each other by separators 34.

As shown on FIG. 4, each anode section 18 comprises mainly a live plane portion 39 made of the metal to be deposited, for example Zn or Sn, in the case of soluble anodes and whose upper extremity 39' is bent in the form of a hook in order to crown the reverted-V shaped upper portion of the associated pin 32 and to be hooked to the same while establishing electric contact.

The vertical portion 39 is fitted laterally with insulating parts 40, for example glued or snapped on the said vertical portion, enabling to electrically isolate the section 18 from the adjacent sections.

FIG. 6 represents schematically the whole electric circuit. Each pin 32 of each anode bridge 14 is linked individually to the positive pole of a continuous current generator via a controlled switching semi-conductor 35.

According to an embodiment represented, the electric supply circuit is connected to the network 36 and comprises a step-down transformer 37 and one or several rectifier bridges 37' whose positive pole is connected to the switching device 35 of each pin 32 of the anode bridge 14 and whose negative pole is connected to the take-up roller 16 over which passes the edge of the band 23 running in front of the anode plate formed by the attached sections 18.

Each switching device 35 enables to let the electric current through, or not, into each anode section 18 and, besides, to adjust at will the value of this current.

Thus, according to the invention, it is possible to supply with electric current the sections 18 making up the anode plate, solely on the portion of the said plate corresponding to the width L (FIG. 5) of the band 23.

Thus, it is not necessary any longer, as in the previous art, to create a stack of width corresponding to the band and to place mechanic masking means on the sides of the band.

Moreover, the invention also enables to adjust to optimum value the current injected into each anode section 18. Indeed, the current lines, hence the current density, which determines the thickness of the deposit, depend on the geometry of the opposite surfaces and particularly on the extremities.

The circuit represented schematically on FIG. 6 and comprising individual supply means of each anode section 18, is associated with a programmable computing unit 41 taking into account the geometrical parameters of the electrodes and of the band as well as all the parameters influencing the process and having means to control the actuation of the power switching semi-conductor-controlled means 35.

As usual, in the case of electrolysis cells with soluble anodes, the anode sections 18 carried by each fractional anode bridge 14 and forming an anode plate are pushed as they are dissolved by the pushing and fixing 19, 20 device.

According to another particularly advantageous characteristic, represented on FIG. 5, each pair of anode benches 13*a*, 13*b* of a coating cell is offset slightly, transversally, with respect to the anode benches of both neighbouring cells. The offset can be, for instance, in the order of the quarter of the width of a bar 18 of the fractional anode plate 13. Thus, the junction planes between the sections 18 of the same anode bench 13 are offset transversally from one cell to the next and, consequently, the electric discontinuity zones, caused by the isolation 40 of the anode sections 18, do not match between two consecutive anode benches and do not reappear therefore at the same location of the band, from one cell to the next, as it would be the case if all the fractional anode benches were geometrically centred on the axis of the band.

Any other relative offset mode of the anode sections can be contemplated, providing the distribution effect remains the same, in the width direction of the band, for the relative position of the isolating zones.

Obviously, the invention is not limited to the details of both embodiments which have just been described previously, whereas equivalent means can be used, without departing from the protection framework defined by the claims, to obtain the same possibility of selective supply of the adjacent sections forming an anode plate.

It is thus that, in the embodiment represented on FIG. 6, the live pins 32 are equal in number to that of the anode sections 18 and are therefore offset by the same pitch. In such a case, the anode sections 18 are each centred on a pin 32 and straddle two pins only when the assembly is pushed to clear the last worn section.

Figure 8:
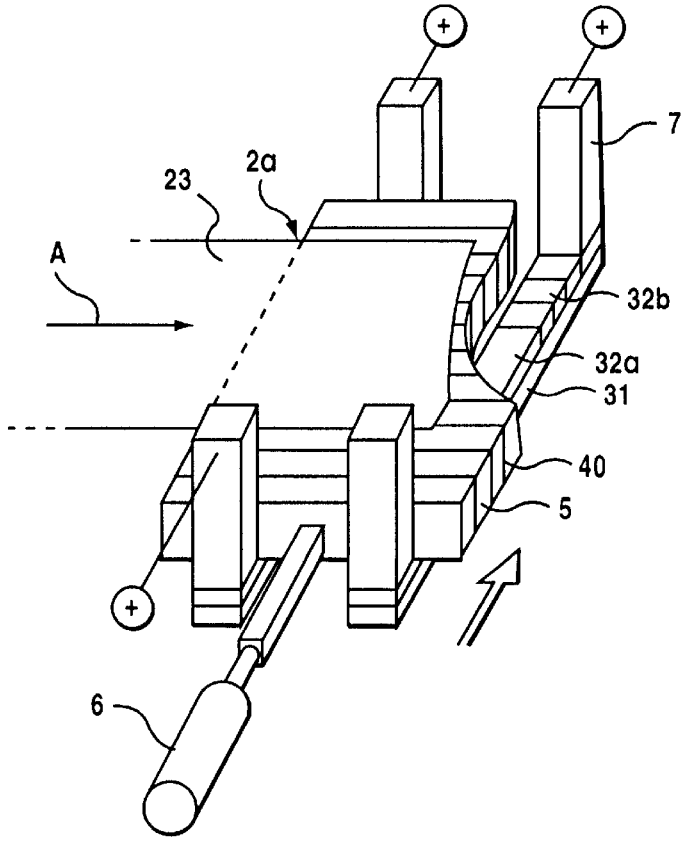
FIG. 8 is a perspective diagram representing an anode bench in an installation with horizontal running direction.

According to a simpler arrangement represented on FIG. 8, the centre part of the anode bridge 14 could be associated with a pin 32*a* of greater length, covering several attached anode sections, whereby both extremities would be composed of several pins 32*b* of smaller length. Thus, it will be possible to suit the width of the band while correcting the edge fringing thanks to selective supply of the pins located at both extremities, whereas the centre part will always be supplied.

Moreover, the invention has been described in the case of plants with vertical cells, but analogous means could be employed in plants with horizontal cells.

Figure 7:
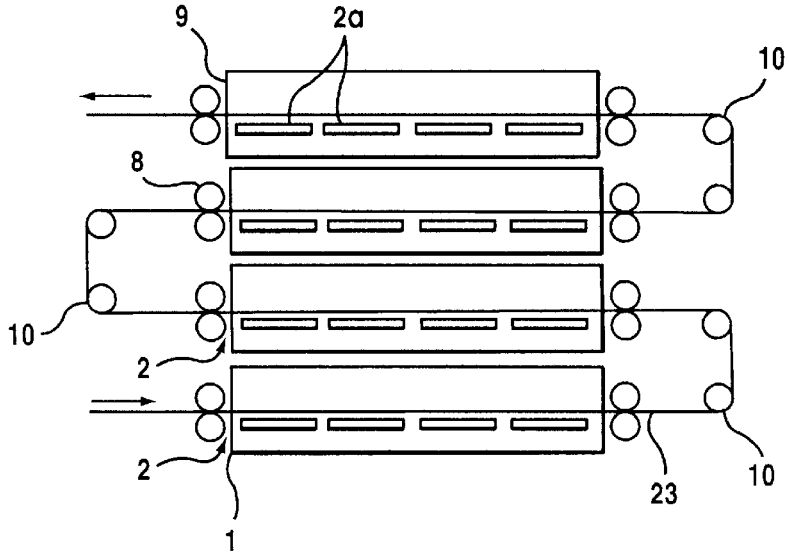
FIG. 7 represents schematically an electrolysis section comprising several superimposed cells with horizontal running direction.

For exemplification purposes, such a tinning plant has been represented schematically on FIG. 7.

The coating section is, in this case, placed in a tub filled with the electrolyte and comprises, for example, four superimposed cells 1 inside which have been inserted several series 2 of horizontal plates 2*a* arranged beside one another. The band 23 follows a zigzag path delineated by deflecting rollers 10 and runs thus successively in alternate directions, respectively from left to right and from right to left, inside each cell, while passing above several anode benches each constituted of a plate 2*a* carried by two supporting beams 7 one of which at least is live and comprises an anode bridge connected to the positive pole of the continuous current source.

As shown on FIG. 8, each plate 2*a* of an anode bench is constituted of a set of tin bars 5 placed beside one another and resting with the possibility of sliding over the supporting beams 7 forming the live anode bridges.

A pushing device 6 enables to push periodically the set of bars 5 while leaving a free space for a new bar, whereas the last bar of the assembly is removed from the other extremity of the anode plate 2*a*. Thus, the bars are renewed as they are dissolved, as their thickness diminishes gradually, from one extremity of the anode bridges to the other.

In each cell, the band 3 is brought to run by two pairs of take-up rollers 8 placed at each extremity of the tub. These rollers are live and connected to the negative pole of the electric generator, whereas the band constitutes the cathode of the electrolysis device.

In well known installations, the length of the anode benches must be suited to the width of the band or else, masks covering both extremities of the anode plate 2*a* constituted by the set of the bars 5 and protruding on either side of the band, must be used.

Thanks to the invention, as was described for vertical anode benches, the bars 5 making up each anode plate are isolated from one another by isolating means 40 and can be supplied selectively with electric current. To this end, each anode bridge comprises a supporting bar 31 on which are fixed a number of live pins 32 isolated electrically and supplied separately by a switching device.

The live pins 32 exhibit a smooth upper face in order to allow the bras to slide, whereas each pin ensuring electric contact with the bar 5 resting on the said.

Thus, it is possible to limit the electrolysis effect to the width covered by the band and, even, to modulate this effect in the transversal direction of the band and from cell to another.

The reference signs inserted after the technical characteristics mentioned in the claims solely aim at facilitating the understanding of the said claims and do not limit their extent in any way.

I claim:

1. An electrolytic coating installation for metallic bands, comprising:

at least one electrolytic bath (12), means (16) to control the running of a metallic band (23) inside the electrolytic bath (12), along a running direction (A);

at least one anode bridge (14) comprising a carrier bar in the form of a carrier beam (31) extending along a horizontal direction, transversally to the running direction of the band (23), at least one anode plate (13) comprised of a set of bars (18) arranged beside one another and each forming an anode section (18) comprising a portion (39) made of the metal to be deposited on the band (3) and soluble by electrolysis, means (19, 20) to control the sliding motion of the said bars (18) along the anode bridge (14), between a supply side and a exhaust side of the bar, for the replacement of a worn bar with a new bar, an electric supply circuit from a continuous electric current source (37') with a negative pole connected by electric contacting means (16) to the metallic band (23) for forming a cathode and positive pole, separate electric supply means displaced from each of the anode sections (18) comprising a number of live pins (32) arranged in succession along the beam (31) of the anode bridge (14), whereas the said live pins (32) are electrically isolated from one another and from the carrier bar (31), wherein the said anode sections (18) rest on the anode bridge (14) via the said pins (32) with the option of sliding along the aligned pins, wherein each live pin (32) is electrically connected to at least one of a positive pin of the current source (37') by an individual controlled switching means (35) or to at least one of an anode section (18) resting on the said live pin (32).

2. An installation according to claim 1, in which each pin (32) of the anode bridge (14) is supplied with current by a controlled semi-conductor power switching device (35).

3. An installation according to claim 1, characterised in that the live pins (32) are equal in number to that of the bars forming the anode sections (18) carried by the anode bridge (14), whereas each covers a width not exceeding that of an anode section (18).

4. An installation according to claim 1, characterised in that the anode bridge (14) comprises, in its central portion, at least one live pin (32*a*) covering several adjacent anode sections (18) and, at each end, at least one live pin (32*b*) covering a width corresponding to one anode section (18).

5. An installation according to one of the claims 2 or 4 in which the electric supply means are associated with a programmable computing unit (41) for selective triggering control of the power switching devices (35) in relation to the sizes of the band (3) and to the anode sections (8).

6. An installation according to claim 5, in which the computing unit (41) is programmed in order to control the electric supply solely for the live pins (32) corresponding to a set of anode sections (18) covering a width not exceeding the width of the band (3).

7. An installation according to one of the claims 1, 3 or 4 in which the band (23) runs vertically in at least one electrolysis cell comprising at least one vertical anode plate composed of bars (18) hanging from an anode bridge (14), characterised in that each live pin (32) of the anode bridge (14) exhibits an upper part with a reverted V-shaped transversal portion and each anode section (18) exhibits in its upper part a bent extremity forming a hook of matching shape, adapted to be hooked onto the live pin (32) while establishing the electric current.

8. An installation according to one of the claims 1, 3 or 4 in which the band (23) runs horizontally in at least one electrolysis cell comprising at least one vertical anode plate composed of adjacent bars (5) resting on an anode bridge (7), characterised in that each live pin (32) of the anode bridge (7) exhibits a smooth upper part aligned with the upper faces of the adjacent pins in order to form a sliding surface of the anode sections (5) while establishing an electric contact with the said anode sections.

9. An installation according to claim 1, comprising a series of anode benches arranged in succession and each comprising an anode pate (13, 13', 2*a*) carried by an anode bridge (14) in which the sealing planes between the anode sections (18, 43, 5) of two successive anode plates (13, 13') will be offset transversally to the running direction (X'X) of the band (3) so that the insulating zones (40) between the sections (18) of two successive anode plates are not aligned according to the direction of the running axis of the band.

* * * * *